US010312651B2

(12) United States Patent
Lai et al.

(10) Patent No.: US 10,312,651 B2
(45) Date of Patent: Jun. 4, 2019

(54) ELECTRONIC DEVICE

(71) Applicants: Tzu-Chien Lai, Taipei (TW); Chia-Chen Lin, Taipei (TW)

(72) Inventors: Tzu-Chien Lai, Taipei (TW); Chia-Chen Lin, Taipei (TW)

(73) Assignee: COMPAL ELECTRONICS, INC., Taipei (TW)

( * ) Notice: Subject to any disclaimer, the term of this patent is extended or adjusted under 35 U.S.C. 154(b) by 0 days.

(21) Appl. No.: 15/924,290

(22) Filed: Mar. 19, 2018

(65) Prior Publication Data

US 2018/0278002 A1 Sep. 27, 2018

Related U.S. Application Data

(60) Provisional application No. 62/474,050, filed on Mar. 20, 2017.

(51) Int. Cl.
*H01R 13/60* (2006.01)
*H01R 33/94* (2006.01)
(Continued)

(52) U.S. Cl.
CPC ..... *H01R 33/94* (2013.01); *H01R 13/6205* (2013.01); *H01R 13/631* (2013.01);
(Continued)

(58) Field of Classification Search
CPC .. H01R 13/22; H01R 13/6205; H01R 13/631; H01R 33/94; H01R 33/945; H01R 33/22
(Continued)

(56) References Cited

U.S. PATENT DOCUMENTS 1,402,999 A * 1/1922 Ashinger ..... H01R 33/22 439/188
2,788,501 A * 4/1957 Buquor ..... H01J 5/56 439/39

(Continued)

FOREIGN PATENT DOCUMENTS

CN 201265834 7/2009
CN 106369497 2/2017

(Continued)

OTHER PUBLICATIONS

"Office Action of Taiwan Counterpart Application," dated Sep. 12, 2018, pp. 1-5.

*Primary Examiner* — Abdullah A Riyami
*Assistant Examiner* — Vladimir Imas
(74) *Attorney, Agent, or Firm* — JCIPRNET

(57) ABSTRACT

An electronic device adapted to be detachably assembled to a lamp holder having a lamp socket is provided. The electronic device includes an adaptor module and a functional module. The adaptor module includes a lamp connector corresponding to the lamp socket, a first connector electrically connected to the lamp connector, and a first engaging member adjacent to the first connector. The functional module includes a second connector and a second engaging member. The second engaging member of the functional module is detachably connected to the first engaging member of the adaptor module. When the functional module is assembled to the adaptor module, the second connector is electrically connected to the first connector.

22 Claims, 10 Drawing Sheets

(51) Int. Cl.

| | |
|---|---|
| ***H01R 13/631*** | (2006.01) |
| ***H01R 33/945*** | (2006.01) |
| ***H01R 13/62*** | (2006.01) |
| *H01R 13/22* | (2006.01) |
| *H01R 33/22* | (2006.01) |

(52) U.S. Cl.
CPC ..... *H01R 33/945* (2013.01); *H01R 33/9453* (2013.01); *H01R 13/22* (2013.01); *H01R 33/22* (2013.01)

(58) Field of Classification Search
USPC ..... 439/39, 236
See application file for complete search history.

(56) References Cited

U.S. PATENT DOCUMENTS 4,011,000 A * 3/1977 Wharton ..... B60N 3/14 439/445
4,443,778 A * 4/1984 Mewissen ..... H01R 33/94 336/90
4,688,874 A * 8/1987 Bjorkman ..... H01J 61/56 315/51
4,776,018 A * 10/1988 Cordier ..... H04B 1/08 381/333
5,121,287 A * 6/1992 Lee ..... H01R 33/9453 313/51
5,286,216 A * 2/1994 Volz ..... H01R 33/0809 362/217.01
5,326,283 A * 7/1994 Chen ..... B60N 3/14 439/501
5,432,500 A * 7/1995 Scripps ..... G08B 17/10 340/12.32
5,593,323 A * 1/1997 Dernehl ..... H01R 13/717 439/638
5,700,154 A * 12/1997 Geary ..... H01R 33/942 439/133
5,707,246 A * 1/1998 Perkins ..... H01R 33/94 439/133
5,828,765 A * 10/1998 Gable ..... H04R 1/028 381/386
5,964,623 A * 10/1999 Maher ..... H01R 13/506 439/483
5,980,057 A * 11/1999 Christie ..... F21V 33/0056 362/234
6,124,673 A * 9/2000 Bishop ..... F21V 19/0095 315/363
6,607,391 B2 * 8/2003 Mendelson ..... H01R 13/6205 219/435
6,748,096 B2 * 6/2004 Chuang ..... H04R 1/026 381/395
7,123,140 B1 * 10/2006 Denes ..... G08C 17/02 340/539.1
7,175,474 B1 * 2/2007 Chang ..... H01R 31/06 439/501
7,275,854 B2 * 10/2007 Dorleijn ..... F21V 19/0095 313/318.06
7,306,488 B2 * 12/2007 Krijne ..... H01R 33/06 439/617
7,351,066 B2 * 4/2008 DiFonzo ..... H01R 13/6205 439/39
7,351,111 B2 * 4/2008 Cheng ..... H01R 27/02 439/638
7,455,435 B2 * 11/2008 Mathews ..... H05B 37/0263 362/378
7,534,104 B2 * 5/2009 Schneider ..... A61C 1/08 361/245
7,641,517 B2 1/2010 Vogt et al.
7,692,555 B2 * 4/2010 Stanley ..... H02J 13/0075 340/12.23
7,874,844 B1 * 1/2011 Fitts, Jr. ..... H01R 31/06 439/218
8,013,537 B2 * 9/2011 Summerland ..... H05B 33/0845 315/291
8,042,961 B2 * 10/2011 Massara ..... F21V 23/0471 362/249.02
8,167,637 B1 * 5/2012 Projkovski ..... H01R 33/962 439/340
8,207,829 B2 * 6/2012 De Goederen-Oei ..... H05B 37/0272 340/12.23
8,226,440 B2 * 7/2012 Mouchon ..... H01R 13/6272 439/617
8,282,227 B2 * 10/2012 Massara ..... F21V 23/0471 362/249.02
8,299,903 B2 * 10/2012 Haase ..... F21V 33/0056 340/326
9,080,749 B2 * 7/2015 Salomon ..... F21V 17/18
9,196,979 B2 * 11/2015 Kim ..... H01R 13/24
9,362,664 B2 * 6/2016 Yen ..... H01R 13/6205
9,374,875 B2 * 6/2016 Ben-Moshe ..... H01R 33/945
9,413,104 B2 * 8/2016 Liao ..... H01R 13/6205
9,644,828 B1 * 5/2017 May ..... F21V 7/00
9,872,091 B2 * 1/2018 Aggarwal ..... H04S 7/302
10,020,626 B1 * 7/2018 Hung ..... H01R 33/22
2005/0255718 A1 * 11/2005 McLeish ..... H01R 13/6205 439/39
2006/0044789 A1 * 3/2006 Curtis ..... F21S 8/088 362/152
2008/0225510 A1 * 9/2008 Rocha ..... F21V 33/0056 362/86
2013/0135873 A1 5/2013 Lee et al.

FOREIGN PATENT DOCUMENTS

| | | |
|---|---|---|
| CN | 206469089 | 9/2017 |
| TW | M1301311 | 11/2006 |
| TW | M424442 | 3/2012 |
| TW | I517697 | 1/2016 |

* cited by examiner

ELECTRONIC DEVICE

CROSS-REFERENCE TO RELATED APPLICATION

This application claims the priority benefit of U.S. provisional application Ser. No. 62/474,050, filed on Mar. 20, 2017. The entirety of the above-mentioned patent application is hereby incorporated by reference herein and made a part of this specification.

BACKGROUND OF THE INVENTION

Field of the Invention

The invention relates to an electronic device, and more particularly, to an electronic device detachably assembled to a lamp holder.

Description of Related Art

With the advancement in technology, more and more electronic products have appeared on the market, such as monitors, speakers, projectors, wireless transmitters, or radios, so as to meet different user needs. In general, if a user is to install such electronic products, then an additional procedure needs to be performed for the individual electronic product to provide a relevant circuit and mounting bracket. Moreover, if such electronic products are to be removed, an additional procedure is also needed to remove the relevant circuit and mounting bracket, which is rather inconvenient.

SUMMARY OF THE INVENTION

The invention provides an electronic device that is rather convenient to install and remove.

An electronic device of the invention is adapted to be detachably assembled to a lamp holder. The lamp holder includes a lamp socket, and the electronic device includes an adaptor module and a functional module. The adaptor module includes a lamp connector corresponding to the lamp socket, a first connector electrically connected to the lamp connector, and a first engaging member adjacent to the first connector. The functional module includes a second connector and a second engaging member, wherein the second engaging member of the functional module is detachably connected to the first engaging member of the adaptor module, and when the functional module is assembled to the adaptor module, the second connector is electrically connected to the first connector.

In an embodiment of the invention, the first connector is different from the lamp socket.

In an embodiment of the invention, the adaptor module includes a first magnetic member adjacent to the first engaging member, the functional module includes a second magnetic member adapted to be attracted to the first magnetic member, when the functional module is located at an initial position relative to the adaptor module, the first magnetic member is dislocated from the second magnetic member, and the first magnetic member is magnetically attracted to the second magnetic member, such that the functional module is rotated to a locked position relative to the adaptor module, and when the functional module is located at the locked position, the first magnetic member is aligned with the second magnetic member, and the second engaging member is firmly secured to the first engaging member.

In an embodiment of the invention, the adaptor module includes a groove, the first magnetic member is located in the groove, the first engaging member includes an engaging groove adjacent to an outer edge of the groove and connected to the groove, the functional module includes a protruding portion corresponding to the groove, the second magnetic member is located at the protruding portion, and the second engaging member is protruded beyond an edge of the protruding portion.

In an embodiment of the invention, the first connector is located in the groove, and the second connector is exposed to the protruding portion.

In an embodiment of the invention, the adaptor module includes a groove, a chute connected to the groove, and a first magnetic member. The first engaging member is movably disposed in the chute, the first engaging member is a magnetic component, and the first magnetic member is adapted to be magnetically attracted to the first engaging member such that the first engaging member is retracted in the chute. The functional module includes a second magnetic member disposed adjacent to the second engaging member, a magnetic force of the second magnetic member is greater than a magnetic force of the first magnetic member, the second engaging member and the second magnetic member form a protruding portion together corresponding to the groove, and the second engaging member has an engaging groove, wherein when the protruding portion of the functional module is extended into the groove of the adaptor module, the second magnetic member attracts the first engaging member such that the first engaging member is extended into the engaging groove.

In an embodiment of the invention, the second engaging member includes an external gear set, the engaging groove is formed between two teeth of the external gear set, the two teeth have two opposite inclined walls, and when the first engaging member is extended into the engaging groove, and the functional module is rotated, the first engaging member is pushed by one of the inclined walls and exits the engaging groove.

In an embodiment of the invention, the first connector is located in the groove, and the second connector is exposed to the protruding portion.

In an embodiment of the invention, one of the first connector and the second connector includes a pogo pin, and the other one includes a curved or circular conductive pad.

In an embodiment of the invention, the functional module includes at least one of a light source module, a camera module, a projection module, a speaker module, a radio module, and a wireless communication module.

In an embodiment of the invention, the adaptor module includes an adaptor circuit board electrically connected to the first connector and the lamp connector, and the adaptor circuit board includes a voice assistant controller.

An electronic device of the invention is adapted to be detachably assembled to a lamp holder. The lamp holder includes a lamp socket, and the electronic device includes an adaptor module. The adaptor module includes a lamp connector corresponding to the lamp socket, a first connector electrically connected to the lamp connector, and an adaptor circuit board. The adaptor module is adapted to be docked to the lamp socket via the lamp connector such that the first connector is electrically connected to the lamp socket, the adaptor circuit board is respectively electrically connected to the first connector and the lamp connector, and the adaptor circuit board includes a voice assistant controller.

In an embodiment of the invention, the first connector is different from the lamp socket.

In an embodiment of the invention, the electronic device further includes a functional module detachably assembled to the adaptor module, wherein the functional module includes a second connector corresponding to the first connector, and when the functional module is assembled to the adaptor module, the second connector is electrically connected to the first connector.

In an embodiment of the invention, the adaptor module includes a first engaging member and a first magnetic member adjacent to the first engaging member, the functional module includes a second engaging member and a second magnetic member adapted to be attracted to the first magnetic member, when the functional module is located at an initial position relative to the adaptor module, the first magnetic member is dislocated from the second magnetic member, and the first magnetic member is magnetically attracted to the second magnetic member, such that the functional module is rotated to a locked position relative to the adaptor module, and when the functional module is located at the locked position, the first magnetic member is aligned with the second magnetic member, and the second engaging member is firmly secured to the first engaging member.

In an embodiment of the invention, the adaptor module includes a groove, the first magnetic member is located in the groove, the first engaging member includes an engaging groove adjacent to an outer edge of the groove and connected to the groove, the functional module includes a protruding portion corresponding to the groove, the second magnetic member is located at the protruding portion, and the second engaging member is protruded beyond an edge of the protruding portion.

In an embodiment of the invention, the first connector is located in the groove, and the second connector is exposed to the protruding portion.

In an embodiment of the invention, the adaptor module includes a groove, a chute connected to the groove, a first engaging member movably disposed in the chute, and a first magnetic member located in or adjacent to the chute, the first engaging member is a magnetic component, and the first magnetic member is adapted to be magnetically attracted to the first engaging member such that the first engaging member is retracted in the chute.

In an embodiment of the invention, the functional module includes a second engaging member and a second magnetic member disposed adjacent to the second engaging member, a magnetic force of the second magnetic member is greater than a magnetic force of the first magnetic member, the second engaging member and the second magnetic member form a protruding portion together corresponding to the groove, and the second engaging member has an engaging groove recessed in a side of the protruding portion, wherein when the protruding portion of the functional module is extended into the groove of the adaptor module, the second magnetic member attracts the first engaging member such that the first engaging member is extended into the engaging groove.

In an embodiment of the invention, the second engaging member includes an external gear set, the engaging groove is formed between two teeth of the external gear set, the two teeth have two opposite inclined walls, and when the first engaging member is extended into the engaging groove, and the functional module is rotated, the first engaging member is pushed by one of the inclined walls and exits the engaging groove.

In an embodiment of the invention, the first connector is located in the groove, and the second connector is exposed to the protruding portion.

Based on the above, the electronic device of the invention can be assembled to a regular lamp holder via a lamp connector design of the adaptor module, and a user can dispose the electronic device of the invention on a desired lamp holder themselves without requiring an additional procedure to provide a relevant circuit and mounting bracket. Therefore, the electronic device of the invention is rather convenient to install. Moreover, in an embodiment, the electronic device can further include a functional module. Since the functional module can be engaged to the adaptor module in a detachable manner and can be electrically connected to the lamp holder via the adaptor module, the user can select the desired type of functional module to be assembled to the adaptor module themselves or switch the functional module as needed to meet the diverse needs of the user.

In order to make the aforementioned features and advantages of the disclosure more comprehensible, embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
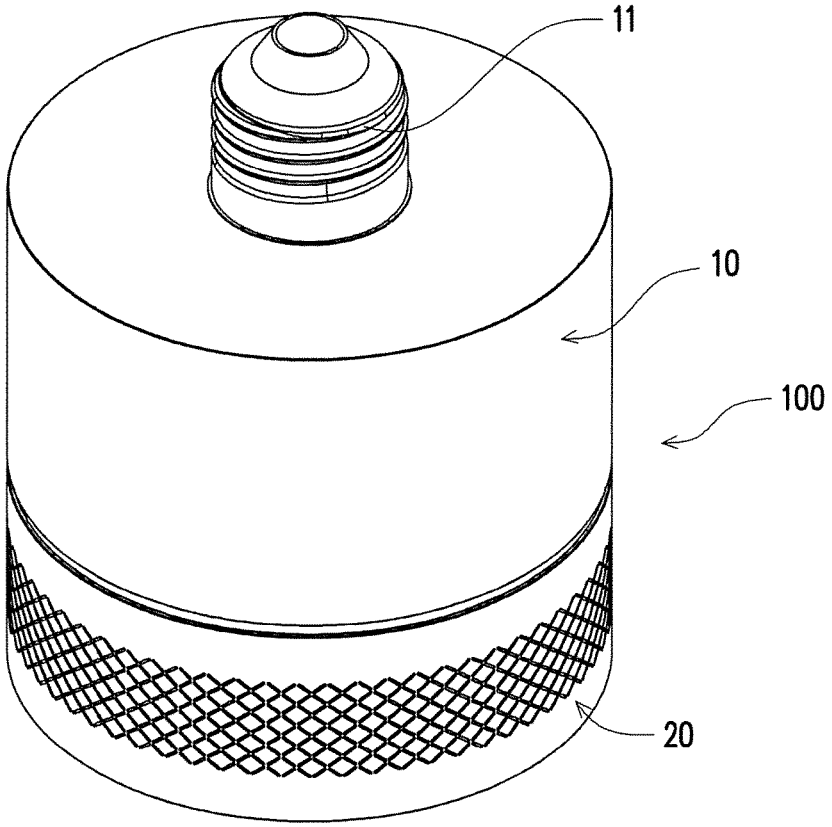
FIG. 1 is a schematic perspective view of a functional module of an electronic device and an assembly thereof to an adaptor module according to an embodiment of the invention.
Figure 2:
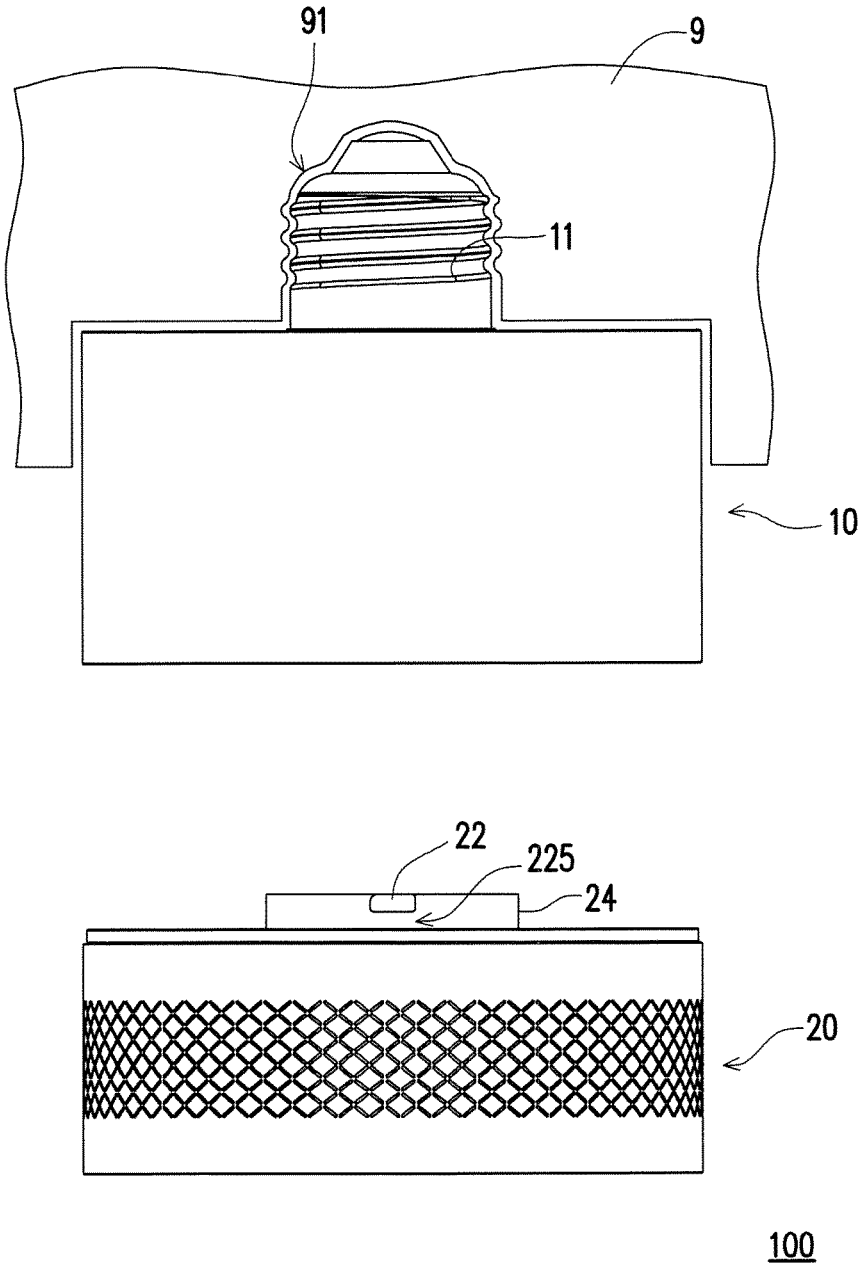
FIG. 2 is a schematic side view of the adaptor module of the electronic device of FIG. 1 assembled to a lamp holder and the functional module thereof removed from the adapter module.

FIG. 1 is a schematic perspective view of a functional module of an electronic device and an assembly thereof to an adaptor module according to an embodiment of the invention. FIG. 2 is a schematic side view of the adaptor module of the electronic device of FIG. 1 assembled to a lamp holder and the functional module thereof removed from the adapter module. Referring to FIG. 1 and FIG. 2, an electronic device 100 of the present embodiment is adapted to be detachably assembled to a lamp holder 9 (shown in FIG. 2). In general, indoor ceiling generally includes a lamp holder 9 in which a light bulb can be installed, and the lamp holder 9 includes a lamp socket 91, such as an E10, E12, E14, E17, E26, E27, or E40 standard female connector. Of course, the type of the lamp socket 91 is not limited thereto.

In the electronic device 100 of the present embodiment, an existing circuit of the lamp holder 9 is used as a power supply circuit for the electronic device 100, and an additional circuit-building procedure is not needed. Moreover, the electronic device 100 can also be directly fixed on the lamp socket 91 after being screwed in the lamp socket 91, and an additional mounting bracket is not needed. In other words, the electronic device 100 of the present embodiment only needs to be directly installed on the existing lamp holder 9 for operation, and the assembly is very simple. Hereinafter, the electronic device 100 of the present embodiment is described in detail.

Figure 3:
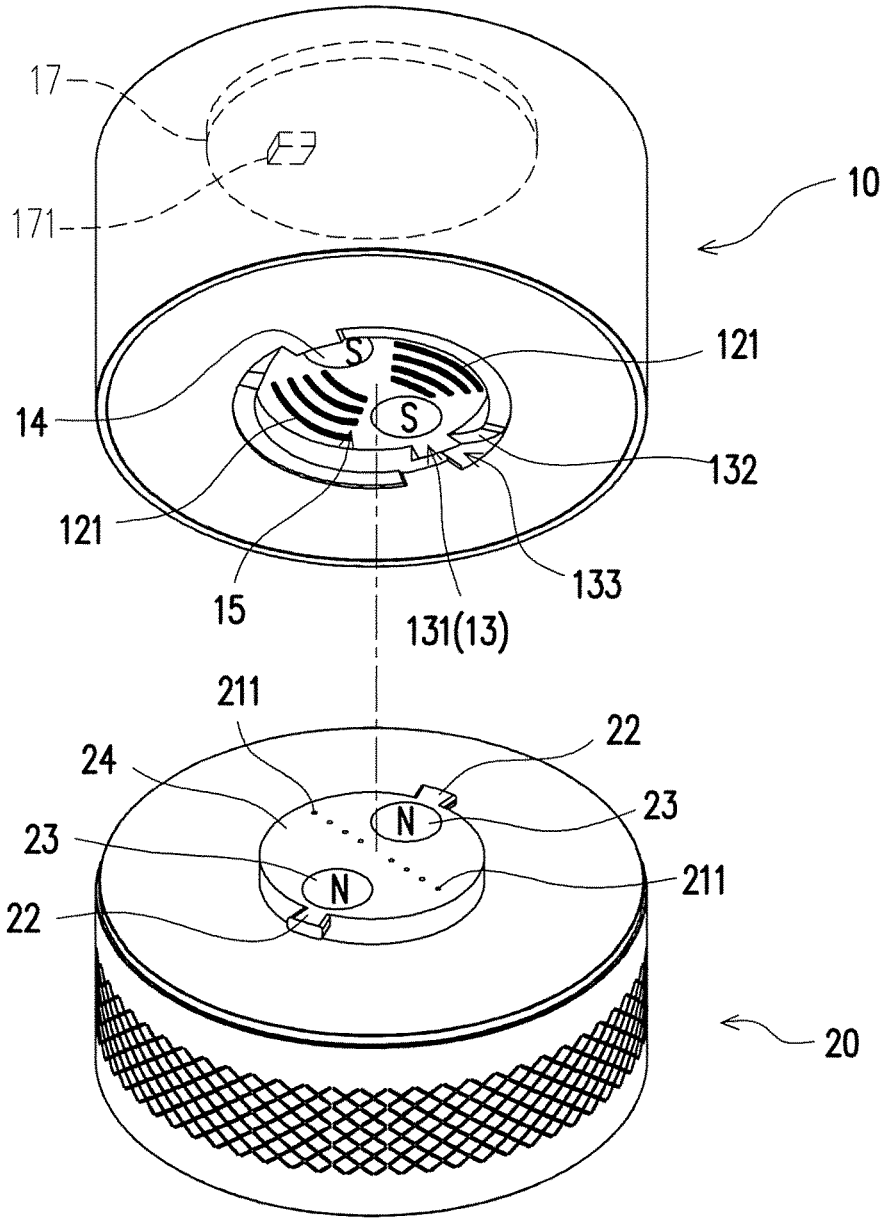
FIG. 3 is a schematic perspective view of the functional module of the electronic device of FIG. 1 removed from the adaptor module.

FIG. 3 is a schematic perspective view of the functional module of the electronic device of FIG. 1 removed from the adaptor module. Referring to FIG. 1 to FIG. 3, in the present embodiment, the electronic device 100 includes an adaptor module 10. The adaptor module 10 includes a lamp connector 11 corresponding to the lamp socket 91, and can be connected to the lamp socket 91 of the lamp holder 9 as shown in FIG. 2. In the present embodiment, the lamp connector 11 is, for instance, an E10, E12, E14, E17, E26, E27, or E40 standard male connector. Of course, the type of the lamp connector 11 is not limited thereto.

As shown in FIG. 3, in the present embodiment, the adaptor module 10 further includes a first connector 121 electrically connected to the lamp connector 11 and an adaptor circuit board 17 electrically connected to the first connector 121 and the lamp connector 11.

In the present embodiment, the type of the first connector 121 is, for instance, different from the type of the lamp socket 91. In other words, the first connector 121 is not a connector for a regular lamp. In the present embodiment, the first connector 121 includes a plurality of curved or circular conductive pads, but the type of the first connector 121 is not limited thereto. In other embodiments, the first connector 121 can also be, for instance, a USB connector, an HDMI connector, or an e-SATA connector. In the present embodiment, the adaptor module 10 is adapted to be docked to the lamp socket 91 via the lamp connector 11 such that the first connector 121 of the adaptor module 10 is electrically connected to the lamp socket 91. In other words, in the present embodiment, when the adaptor module 10 is assembled to the lamp holder 9, the external interface of the lamp holder 9 is changed from the lamp socket 91 to the first connector 121 of the adaptor module 10. If a module has a connector corresponding to the first connector 12, then the module can be directly connected to the adaptor module 10. Of course, in other embodiments, the type of the first connector 121 can also be the same as the type of the lamp socket 91.

In the present embodiment, the adaptor module 10 further includes a first engaging member 13 adjacent to the first connector 121, the adaptor module 10 has a groove 15, the first connector 121 is located in the groove 15, and the first engaging member 13 includes at least one engaging groove 131 adjacent to the outer edge of the groove 15 and connected to the groove 15, but the type of the first engaging member 13 is not limited thereto. In the present embodiment, the number of the engaging groove 131 is, for instance, two, but the number of the engaging groove 131 is not limited thereto.

Moreover, in the present embodiment, the electronic device 100 can further optionally include a functional module 20. In the present embodiment, the functional module 20 includes at least one of a light source module, a camera module, a projection module, a speaker module, a radio module, and a wireless communication module. Of course, the functional module 20 can also be other functional modules, and the type of the functional module 20 is not limited thereto. The functional module 20 includes a second connector 211 and at least one second engaging member 22. The second engaging member 22 of the functional module 20 is detachably connected to the first engaging member 13 of the adaptor module 10. In the present embodiment, the number of the second engaging member 22 is two, and the second engaging member 22 includes an engaging block, but the number and type of the second engaging member 22 are not limited thereto.

It can be seen from FIG. 3 that, the functional module 20 can include a protruding portion 24 corresponding to the groove 15, the second connector 211 is exposed to the protruding portion 24, and the second engaging members 22 are protruded beyond the edge of the protruding portion 24. In the present embodiment, the second connector 211 includes a plurality of pogo pins, but the type of the second connector 211 is not limited thereto as long as the second connector 211 can be docked to the first connector 121.

In the present embodiment, the groove 15 of the adaptor module 10 and the protruding portion 24 of the functional module 20 allow rapid alignment of a user. When the functional module 20 is to be assembled to the adaptor module 10, the second engaging members 22 can be slid into the first engaging member 13 along an inclined plane 132 of the engaging groove 131 simply by aligning the protruding portion 24 of the functional module 20 with the groove 15 of the adaptor module 10 and aligning the second engaging members 22 (such as engaging blocks) with an opening 133 of the engaging groove 131. Since a space 225 (shown in FIG. 2) exists between the second engaging members 22 radially protruding beyond the protruding portion 24 and the housing of the functional module 20, upon completion of the assembly, a portion of the housing of the adaptor module 10 is extended into the space 225 between the second engaging members 22 and the housing of the functional module 20 to complete the engagement. On the other hand, when the functional module 20 is to be detached from the adaptor module 10, the user only needs to rotate the adaptor module 10 to move the second engaging members 22 out of the first engaging member 13 to release the engagement of the first engaging member 13 and the second engaging members 22, and therefore installation and removal are very convenient.

Moreover, it can be seen from FIG. 3 that, the position of the first connector 121 of the adaptor module 10 corresponds to the position of the second connector 211 of the functional module 20, and therefore when the functional module 20 is assembled to the adaptor module 10, the second connector 211 can be in contact with the first connector 121 to be electrically connected to the first connector 121. Therefore, in the present embodiment, when the functional module 20 is assembled to the adaptor module 10 and the electronic device 100 is assembled to the lamp holder 9, the second connector 211 of the functional module 20 is electrically connected to the lamp socket 91 of the lamp holder 9 via the first connector 121 of the adaptor module 10 and the lamp connector 11. In other words, the lamp socket 91 of the lamp holder 9 can provide power to the adaptor module 10 and the functional module 20 for operation, and an additional wiring procedure is not needed.

Moreover, it can be seen from FIG. 3 that, in the present embodiment, the adaptor module 10 can further include at least one first magnetic member 14 adjacent to the first engaging member 13, and in the present embodiment, the adaptor module 10 has two first magnetic members 14, but the number of the first magnetic member 14 is not limited thereto. The first magnetic members 14 can be located in the groove 15, and the connecting line of the two first magnetic members 14 can pass through the center of the groove 15. Moreover, in the present embodiment, the functional module 20 can further include at least one second magnetic member 23 adapted to be attracted to the first magnetic members 14. In the present embodiment, the functional module 20 has two second magnetic members 23, but the number of the second magnetic member 23 is not limited thereto. The second magnetic members 23 are located at the protruding portion 24, and the connecting line of the two second magnetic members 23 can pass through the center of the protruding portion 24. In the present embodiment, the first magnetic members 14 and the second magnetic members 23 are both magnets, and the magnetic pole of the first magnetic members 14 is opposite to the magnetic pole of the second magnetic members 23. Of course, in other embodiments, one of the first magnetic members 14 and the second magnetic members 23 can be a magnet and the other one a magnetic component, and the types of the first magnetic members 14 and the second magnetic members 23 are not limited thereto.

In the present embodiment, when the functional module 20 is about to be installed on the adaptor module 10 and the second engaging members 22 (such as engaging block) is aligned with the opening 133 of the engaging groove 131 (such as the initial position), the first magnetic members 14 of the adaptor module 10 are displaced from the second magnetic members 23 of the functional module 20. At this point, since the second magnetic members 23 of the functional module 20 are attracted by the first magnetic members 14 of the adaptor module 10, the functional module 20 is rotated relative to the adaptor module 10 until the second engaging members 22 slide into the locked position in the first engaging member 13. In other words, in the present embodiment, when the functional module 20 is to be assembled to the adaptor module 10, as long as the protruding portion 24 of the functional module 20 is aligned with the groove 15 of the adaptor module 10, the second magnetic members 23 of the functional module 20 are attracted by the first magnetic members 14 of the adaptor module 10 such that the functional module 20 is rotated to the locked position relative to the adaptor module 10, and installation is more convenient and simpler. Of course, in other embodiments, the electronic device 100 can also omit the first magnetic members 14 and the second magnetic members 23, and the user can also achieve engagement by slightly rotating the functional module 20 in a manual manner. The cooperation of the first engaging member 13 and the second engaging members 22 can provide the effect of rapid installation and removal.

In the electronic device 100 of the present embodiment, via the adaptor module 10 has the design of the lamp connector 11, the adaptor module 10 can be assembled to a regular lamp holder 9, and the adaptor module 10 is assembled to the lamp holder 9 in the same manner that a light bulb is installed, in which the lamp connector 11 of the adaptor module 10 is screwed into the lamp socket 91 of the lamp holder 9 to complete the structural and electrical connection. The user can dispose the electronic device 100 of the invention on a desired lamp holder 9 themselves without requiring an additional procedure to provide a relevant circuit and mounting bracket, and therefore installation and removal are rather convenient.

Moreover, since the functional module 20 can be assembled to the adaptor module 10 in a detachable manner and can be electrically connected to the lamp holder 9 via the adaptor module 10, the user can select the desired type of functional module 20 to be assembled to the adaptor module 10 themselves or switch the functional module 20 as needed to meet the diverse needs of the user. For instance, when the user is to use the projection function, the user only needs to install the functional module 20 having a projection module to the adaptor module 10. When the user is to change to the monitor function, the user can remove the functional module 20 having a projection module and install the functional module 20 having a camera module to the adaptor module 10 instead. Under regular conditions, a functional module 20 having a light source module can also be installed to the adaptor module 10 to provide lighting. Of course, the functional module 20 can also have a plurality of functions at the same time to meet a variety of demands at the same time.

It should be mentioned that, in the present embodiment, the adaptor circuit board 17 of the adaptor module 10 can have, for instance, a voice assistant controller 171, which can provide the function of voice assistant. A signal connection can be established between the adaptor module 10 and the functional module 20 via the first connector 121 and the second connector 211 or via a wireless method. If the functional module 20 having a light source module is installed on the adaptor module 10, then when the voice assistant controller 171 receives an instruction to turn the lights on or off or to adjust the brightness, the functional module 20 can be controlled to operate accordingly using a wired or wireless method to achieve the effect of a smart home. Of course, the voice assistant controller 171 can control different functional modules 20 via settings.

Figure 4:
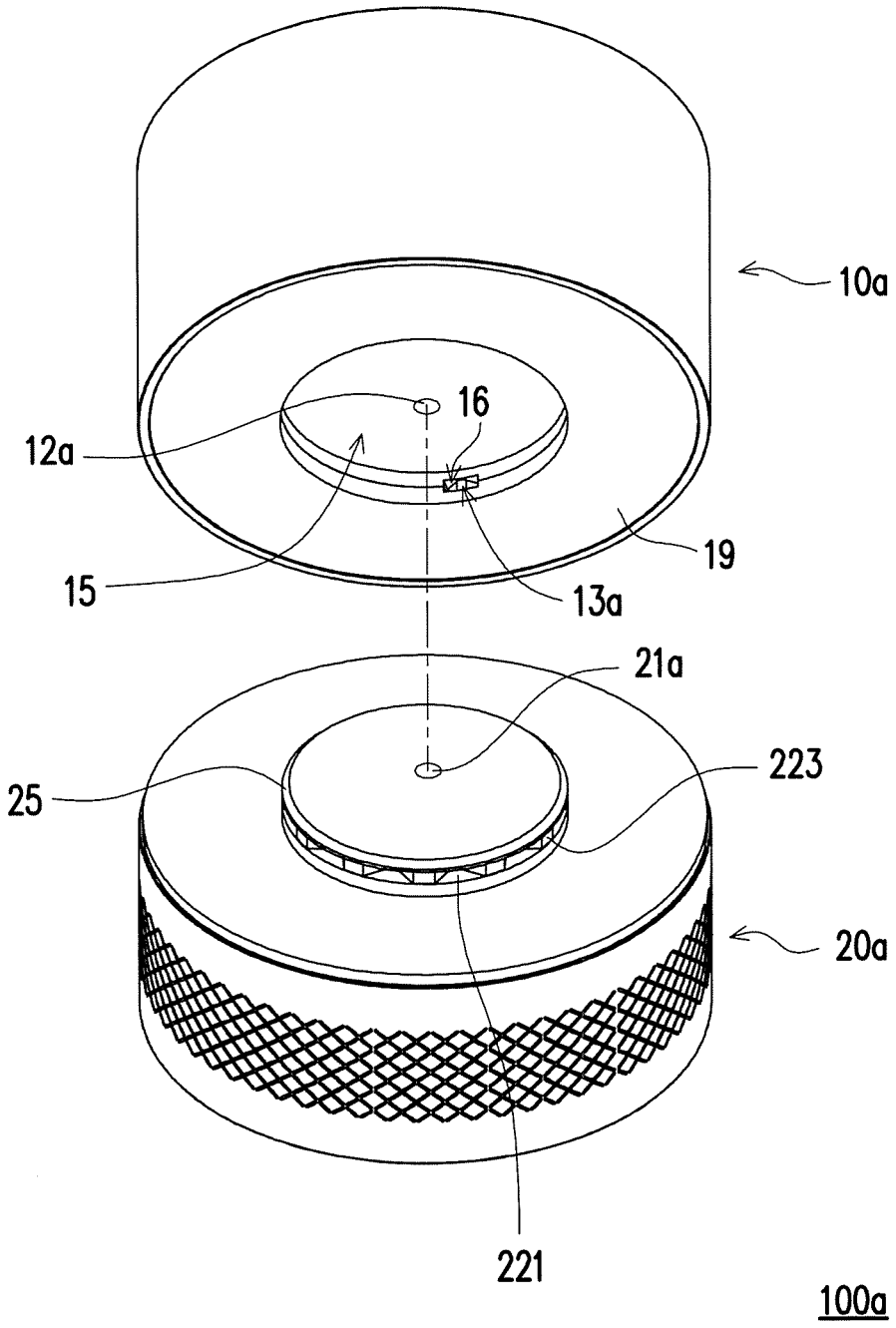
FIG. 4 is a schematic perspective view of a functional module of an electronic device removed from an adaptor module according to another embodiment of the invention.
Figure 5:
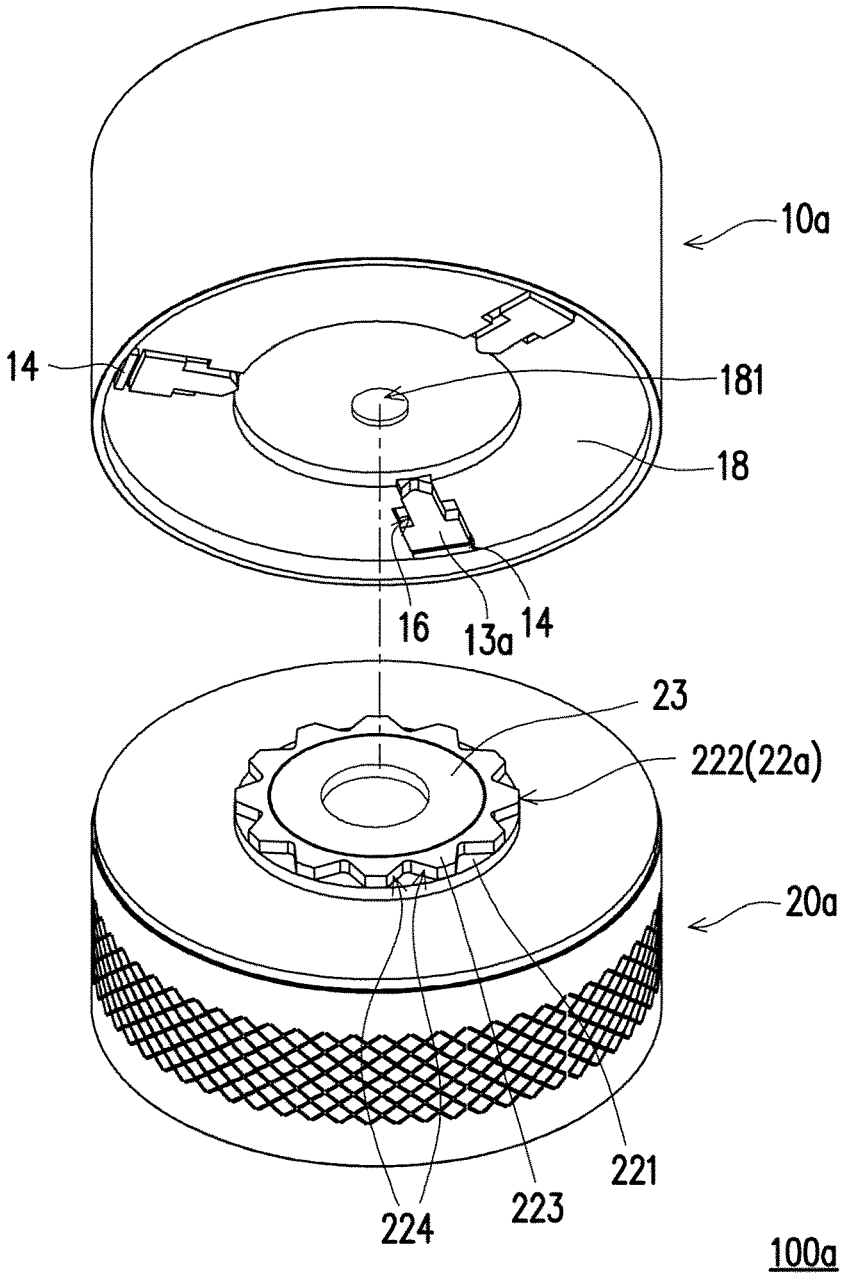
FIG. 5 is a schematic perspective view of the adaptor module of FIG. 4 hiding a cover and the functional module of FIG. 4 hiding a modified cover.
Figure 6:
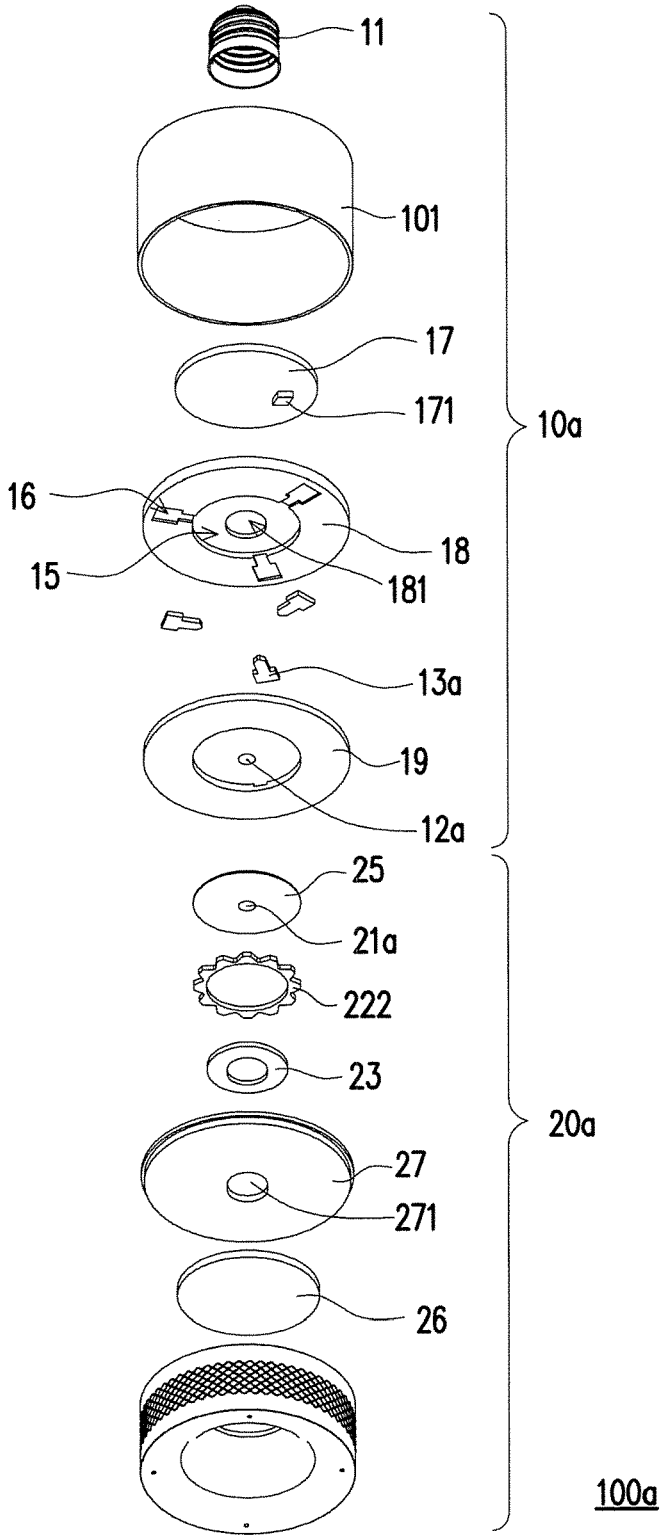
FIG. 6 and FIG. 7 are respectively schematic exploded views of the electronic device of FIG. 4 in different perspectives.
Figure 7:
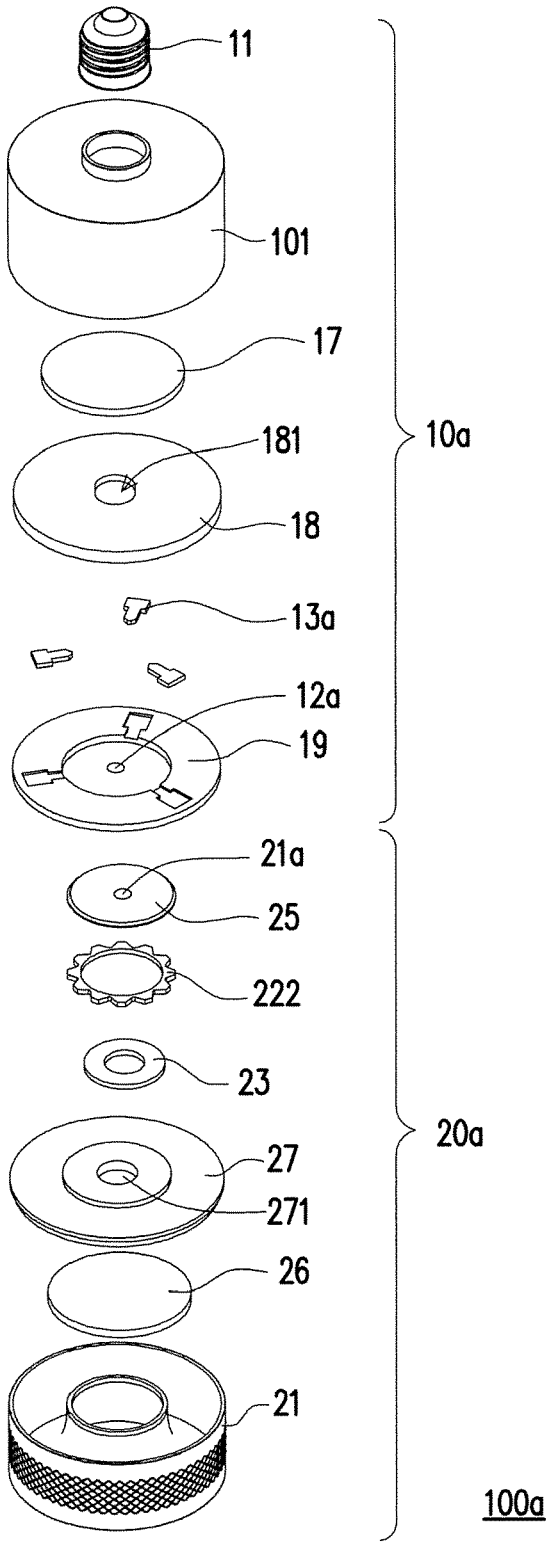

FIG. 4 is a schematic perspective view of a functional module of an electronic device removed from an adaptor module according to another embodiment of the invention. FIG. 5 is a schematic perspective view of the adaptor module of FIG. 4 hiding a cover and the functional module of FIG. 4 hiding a modified cover. FIG. 6 and FIG. 7 are respectively schematic exploded views of the electronic device of FIG. 4 in different perspectives. It should be mentioned that, FIG. 6 and FIG. 7 only schematically show the main elements, and elements such as wires connected between the circuit board and the connectors are omitted. Referring to FIG. 4 to FIG. 7, the main difference between an electronic device 100*a* of the present embodiment and the electronic device 100 of the previous embodiment is that the engagement method between an adaptor module 10*a* and a functional module 20*a* is different from the engagement method between the adaptor module 10 and the functional module 20.

Specifically, as shown in FIG. 5, in the present embodiment, the adaptor module 10*a* includes a chute 16 connected to a groove 15 (shown in FIG. 4) and a restoring member adjacent to the bottom of the chute 16. In the present embodiment, the restoring member is exemplified by a first magnetic member 14, but the type of the restoring member is not limited thereto. In the present embodiment, a first engaging member 13*a* is movably disposed in the chute 16, the first engaging member 13*a* is a latching magnetic component, and the first magnetic member 14 is adapted to be magnetically attracted to the first engaging member 13*a* such that the first engaging member 13*a* is retracted in the chute 16. In other words, when the adaptor module 10*a* is not yet connected to the functional module 20*a*, the first engaging member 13*a* is attracted by the first magnetic member 14 and retracted in the chute 16.

Moreover, in the present embodiment, a second engaging member 22*a* of the functional module 20*a* includes an external gear set 222, the external gear set 222 has a plurality of teeth 223, and the adjacent two teeth 223 have an engaging groove 221 therebetween. The functional module 20*a* includes a second magnetic member 23 disposed adjacent to the second engaging member 22*a* (such as inside). In the present embodiment, the magnetic force of the second magnetic member 23 is greater than the magnetic force of the first magnetic member 14.

Moreover, it can be seen from FIG. 6 and FIG. 7 that, in the present embodiment, the chute 16 of the adaptor module 10*a* is formed on both an inner housing 18 and a cover 19, the groove 15 (shown in FIG. 4) is formed on the cover 19, the first connector 12*a* is disposed on the cover 19 and located in the groove 15, the adaptor circuit board 17 is located between a housing seat 101 and the inner housing 18, and the inner housing 18 has a hole 181 to allow a wire (not shown) connected between the adaptor circuit board 17 and the first connector 12*a* to pass through. A circuit board 26 of the functional module 20*a* is located between an outer housing 21 and a separator 27, the second connector 21*a* is located on a modified cover 25, and the separator 27 has a perforation 271 and the second magnetic member 23 is a hollow ring to allow a wire (not shown) connected between the circuit board 26 and the second connector 21*a* to pass through. In the present embodiment, a portion of the separator 27, the second engagement member 22*a*, the second magnetic member 23, and the modified cover 25 form a protruding portion together corresponding to the groove 15.

Figure 8:
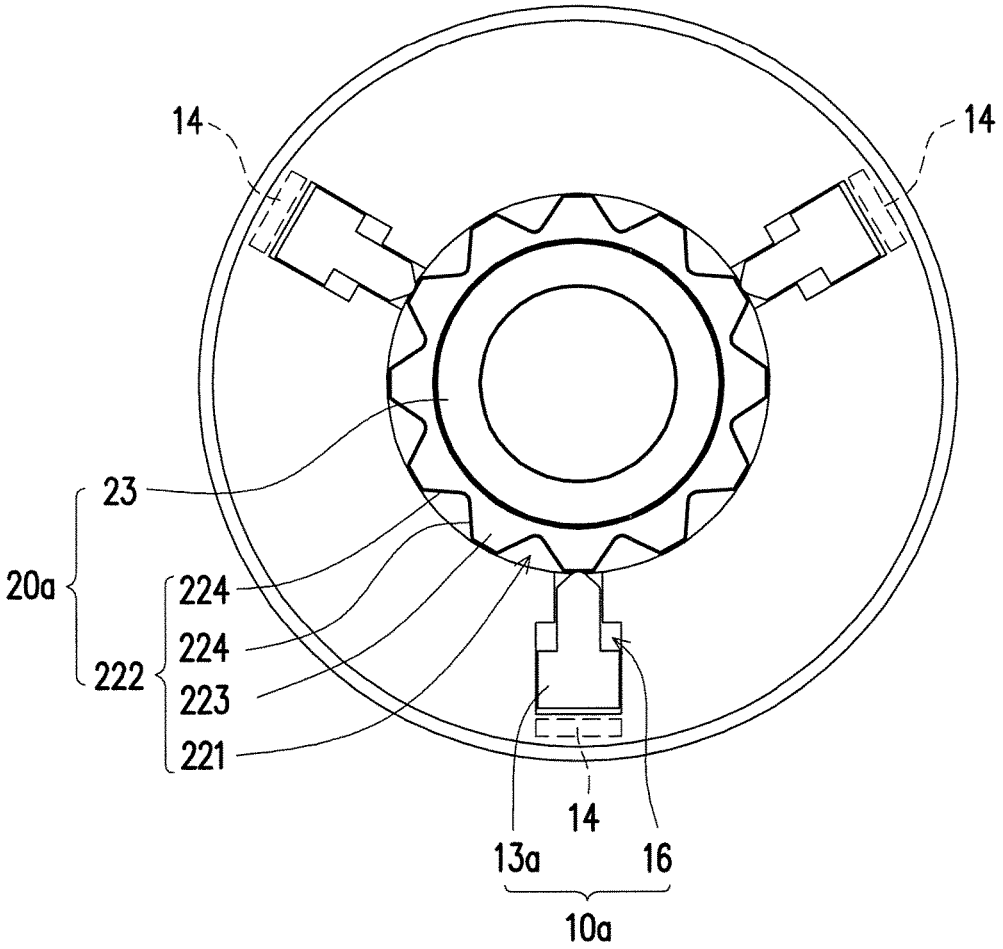
FIG. 8 to FIG. 10 are schematic action views of the first engaging member of the adaptor module of the electronic device of FIG. 4 and the second engaging member of the functional module thereof.
Figure 9:
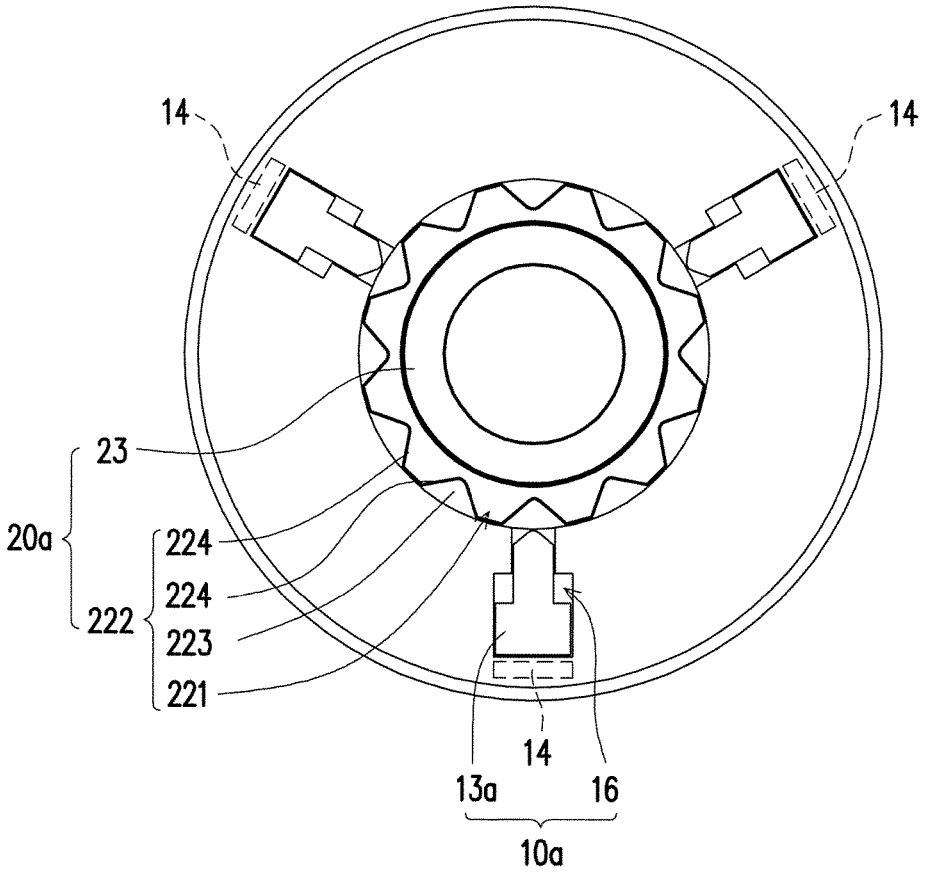
Figure 10:
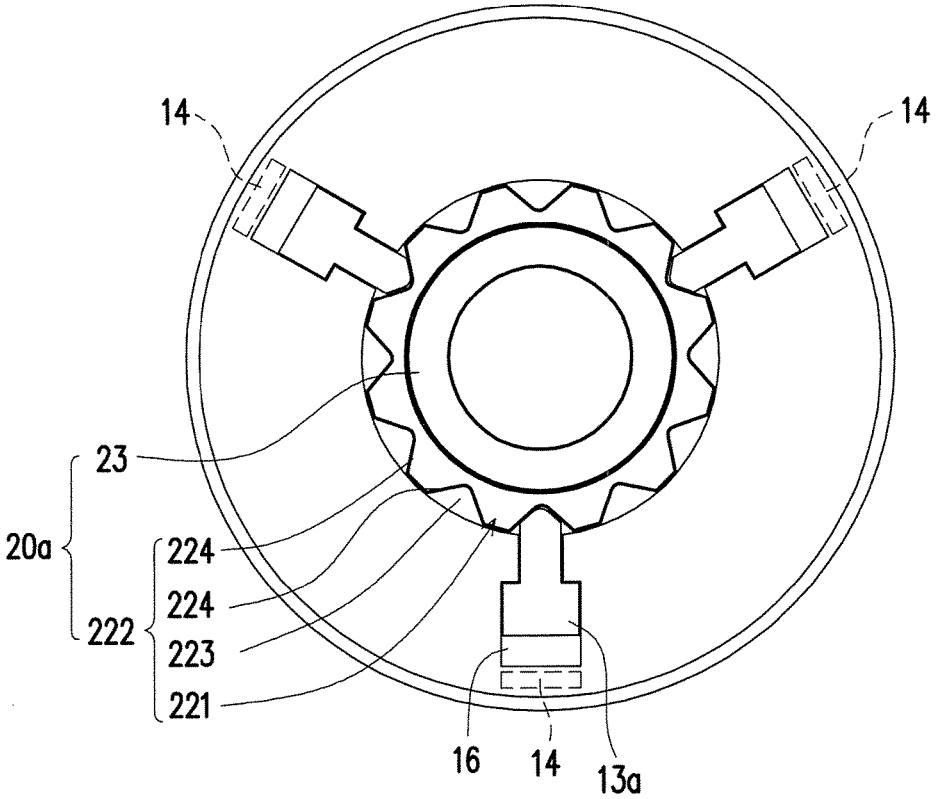

FIG. 8 to FIG. 10 are schematic action views of the first engaging member of the adaptor module of the electronic device of FIG. 4 and the second engaging member of the functional module thereof. It should be mentioned that, in FIG. 8 to FIG. 10, to clearly show the action between the first engaging member 13*a* of the adaptor module 10*a* and the outer gear set 222 of the functional module 20*a*, only a portion of the functional module 20*a* is shown. Referring to FIG. 8 first, when the protruding portion of the functional module 20*a* is extended into the groove 15 of the adaptor module 10*a*, if the first engaging member 13*a* is aligned with the teeth 223 of the outer gear set 222, then the user only needs to slightly rotate the functional module 20*a* to the state of FIG. 9 such that the first engaging member 13*a* corresponds to the engaging groove 221 of the outer gear set 222. In the present embodiment, since the magnetic force of the second magnetic member 23 of the functional module 20*a* is greater than the magnetic force of the first magnetic member 14 of the adaptor module 10*a*, the magnetic first engaging member 13*a* is attracted by the second magnetic member 23 of the functional module 20*a* and is moved out of the chute 16 (i.e., inside the groove 15 as shown in FIG. 5). As a result, the first engaging member 13*a* is extended into the engaging groove 221 of the outer gear set 222 as shown in FIG. 10 to complete the engagement.

In the present embodiment, the adjacent two teeth 223 of the outer gear set 222 have two opposite inclined walls 224 therebetween, and when the functional module 20*a* is to be removed, the first engaging member 13*a* originally located in the engaging groove 221 is pushed by one of the inclined walls 224 and exits the engaging groove 221 simply by slightly rotating the functional module 20*a*. After the functional module 20*a* is separated from the adaptor module 10*a*, the first engaging member 13*a* is attracted by the first magnetic member 14 again and retracted in the chute 16. Of course, in other embodiments, the restoring member can also be replaced by an elastic member (such as a spring) connected to the first engaging member 13*a*, provided the pull from the elastic member to the first engaging member 13*a* is less than the magnetic force from the second magnetic member 23 to the first engaging member 13*a*.

In summary, the electronic device of the invention can be assembled to a regular lamp holder via a lamp connector design of the adaptor module, and the user can dispose the electronic device of the invention on a desired lamp holder themselves without requiring an additional procedure to provide a relevant circuit and mounting bracket. Therefore, the electronic device of the invention is rather convenient to install. Moreover, in an embodiment, the electronic device can further include a functional module. Since the functional module can be engaged to the adaptor module in a detachable manner and can be electrically connected to the lamp holder via the adaptor module, the user can select the desired type of functional module to be assembled to the adaptor module themselves or switch the functional module as needed to meet the diverse needs of the user. Moreover, the functional module and the adaptor module are fixed via an engagement method, such that installation and removal are more convenient and the function of rapid installation and removal is achieved.

Although the invention has been described with reference to the above embodiments, it will be apparent to one of ordinary skill in the art that modifications to the described embodiments may be made without departing from the spirit of the invention. Accordingly, the scope of the invention is defined by the attached claims not by the above detailed descriptions.

What is claimed is:

1. An electronic device adapted to be detachably assembled to a lamp holder, wherein the lamp holder comprises a lamp socket, and the electronic device comprises:

an adaptor module comprising a lamp connector corresponding to the lamp socket, a first connector electrically connected to the lamp connector, and a first engaging member adjacent to the first connector; and a functional module comprising a second connector and a second engaging member, wherein the second engaging member of the functional module is detachably connected to the first engaging member of the adaptor module, and when the functional module is assembled to the adaptor module, the second connector is electrically connected to the first connector, wherein when the functional module is in an initial position, at least one portion of the second engaging member is misaligned with the first engaging member, and when the functional module is rotated to a locked position, the second engaging member is slid into the first engaging member, the functional module is detachably fixed to the adapter module by an engagement between the first engaging member and the at least one portion of the second engaging member.

2. The electronic device of claim 1, wherein the first connector is different from the lamp socket.

3. The electronic device of claim 1, wherein the adaptor module comprises a first magnetic member adjacent to the first engaging member, the functional module comprises a second magnetic member adapted to be attracted to the first magnetic member, when the functional module is located at the initial position relative to the adaptor module, the first magnetic member is dislocated from the second magnetic member, and the first magnetic member is magnetically attracted to the second magnetic member, such that the functional module is rotated to the locked position relative to the adaptor module, and when the functional module is located at the locked position, the first magnetic member is aligned with the second magnetic member, and the second engaging member is firmly secured to the first engaging member.

4. The electronic device of claim 3, wherein the adaptor module comprises a groove, the first magnetic member is located in the groove, the first engaging member comprises an engaging groove adjacent to an outer edge of the groove and connected to the groove, the functional module comprises a protruding portion corresponding to the groove, the second magnetic member is located at the protruding portion, and the second engaging member is protruded beyond an edge of the protruding portion.

5. The electronic device of claim 4, wherein the first connector is located in the groove, and the second connector is exposed to the protruding portion.

6. The electronic device of claim 1, wherein the adaptor module comprises a groove, a chute connected to the groove, and a first magnetic member, the first engaging member is movably disposed in the chute, the first engaging member is a magnetic component, and the first magnetic member is adapted to be magnetically attracted to the first engaging member such that the first engaging member is retracted in the chute.

7. The electronic device of claim 6, wherein the functional module comprises a second magnetic member disposed adjacent to the second engaging member, a magnetic force of the second magnetic member is greater than a magnetic force of the first magnetic member, the second engaging member and the second magnetic member form a protruding portion together corresponding to the groove, and the second engaging member has an engaging groove, wherein when the protruding portion of the functional module is extended into the groove of the adaptor module, the second magnetic member attracts the first engaging member such that the first engaging member is extended into the engaging groove.

8. The electronic device of claim 7, wherein the second engaging member comprises an external gear set, the engaging groove is formed between two teeth of the external gear set, the two teeth have two opposite inclined walls, and when the first engaging member is extended into the engaging groove, and the functional module is rotated, the first engaging member is pushed by one of the inclined walls and exits the engaging groove.

9. The electronic device of claim 7, wherein the first connector is located in the groove, and the second connector is exposed to the protruding portion.

10. The electronic device of claim 1, wherein one of the first connector and the second connector comprises a pogo pin, and the other one comprises a curved or circular conductive pad.

11. The electronic device of claim 1, wherein the functional module comprises at least one of a light source module, a camera module, a projection module, a speaker module, a radio module, and a wireless communication module.

12. The electronic device of claim 1, wherein the adaptor module comprises an adaptor circuit board electrically connected to the first connector and the lamp connector, and the adaptor circuit board comprises a voice assistant controller.

13. An electronic device adapted to be detachably assembled to a lamp holder, wherein the lamp holder comprises a lamp socket, and the electronic device comprises:

an adaptor module comprising a lamp connector corresponding to the lamp socket, a first connector electrically connected to the lamp connector, and an adaptor circuit board, wherein the adaptor module is adapted to be docked to the lamp socket via the lamp connector such that the first connector is electrically connected to the lamp socket, the adaptor circuit board is respectively electrically connected to the first connector and the lamp connector, and the adaptor circuit board comprises a voice assistant controller.

14. The electronic device of claim 13, wherein the first connector is different from the lamp socket.

15. The electronic device of claim 13, further comprising:

a functional module detachably assembled to the adaptor module, wherein the functional module comprises a second connector corresponding to the first connector, and when the functional module is assembled to the adaptor module, the second connector is electrically connected to the first connector.

16. The electronic device of claim 15, wherein the adaptor module comprises a first engaging member and a first magnetic member adjacent to the first engaging member, the functional module comprises a second engaging member and a second magnetic member adapted to be attracted to the first magnetic member, when the functional module is located at an initial position relative to the adaptor module, the first magnetic member is dislocated from the second magnetic member, and the first magnetic member is magnetically attracted to the second magnetic member, such that the functional module is rotated to a locked position relative to the adaptor module, and when the functional module is located at the locked position, the first magnetic member is aligned with the second magnetic member, and the second engaging member is firmly secured to the first engaging member.

17. The electronic device of claim 16, wherein the adaptor module comprises a groove, the first magnetic member is located in the groove, the first engaging member comprises an engaging groove adjacent to an outer edge of the groove and connected to the groove, the functional module comprises a protruding portion corresponding to the groove, the second magnetic member is located at the protruding portion, and the second engaging member is protruded beyond an edge of the protruding portion.

18. The electronic device of claim 17, wherein the first connector is located in the groove, and the second connector is exposed to the protruding portion.

19. The electronic device of claim 15, wherein the adaptor module comprises a groove, a chute connected to the groove, a first engaging member movably disposed in the chute, and a first magnetic member located in or adjacent to the chute, the first engaging member is a magnetic component, and the first magnetic member is adapted to be magnetically attracted to the first engaging member such that the first engaging member is retracted in the chute.

20. The electronic device of claim 19, wherein the functional module comprises a second engaging member and a second magnetic member disposed adjacent to the second engaging member, a magnetic force of the second magnetic member is greater than a magnetic force of the first magnetic member, the second engaging member and the second magnetic member form a protruding portion together corresponding to the groove, and the second engaging member has an engaging groove recessed in a side of the protruding portion, wherein when the protruding portion of the functional module is extended into the groove of the adaptor module, the second magnetic member attracts the first engaging member such that the first engaging member is extended into the engaging groove.

21. The electronic device of claim 20, wherein the second engaging member comprises an external gear set, the engaging groove is formed between two teeth of the external gear set, the two teeth have two opposite inclined walls, and when the first engaging member is extended into the engaging groove, and the functional module is rotated, the first engaging member is pushed by one of the inclined walls and exits the engaging groove.

22. The electronic device of claim 20, wherein the first connector is located in the groove, and the second connector is exposed to the protruding portion.

* * * * *